US005930866A

United States Patent [19]

Rupprechter

[11] Patent Number: 5,930,866

[45] Date of Patent: Aug. 3, 1999

[54] HINGE FOR FURNITURE

[75] Inventor: Helmut Rupprechter, Dornbirn, Austria

[73] Assignee: Julius Blum Gesellschaft m.b.H., Hochst, Austria

[21] Appl. No.: 08/915,323

[22] Filed: Aug. 20, 1997

[30] Foreign Application Priority Data

Aug. 21, 1996 [AT] Austria ..... 483/96 U

[51] Int. Cl.[6] ..... E05D 7/04

[52] U.S. Cl. ..... 16/242; 16/235; 16/246

[58] Field of Search ..... 16/235–242, 246, 16/249, DIG. 40, DIG. 34

[56] References Cited

U.S. PATENT DOCUMENTS

| | | | |
|---|---|---|---|
| 2,724,144 | 11/1955 | Lohrman | 16/242 |
| 3,908,226 | 9/1975 | Read et al. | 16/237 |
| 4,142,271 | 3/1979 | Busse | 16/238 |
| 4,554,706 | 11/1985 | Rock et al. | 16/237 |
| 4,680,830 | 7/1987 | Rock et al. | 16/241 |
| 5,283,929 | 2/1994 | Lin | 16/249 |
| 5,621,947 | 4/1997 | Fitz et al. | 16/240 |
| 5,664,288 | 9/1997 | Lautenschlager et al. | 16/249 |
| 5,737,804 | 4/1998 | Ferrari et al. | 16/242 |

FOREIGN PATENT DOCUMENTS

| | | |
|---|---|---|
| 367 850 | 8/1982 | Austria . |
| 25 42 462 | 3/1977 | Germany . |
| 95/06181 | 3/1995 | WIPO . |

*Primary Examiner*—Chuck Y. Mah
*Attorney, Agent, or Firm*—Wenderoth, Lind & Ponack, L.L.P.

[57] ABSTRACT

A hinge for articulating a door to a frame of a piece of furniture includes a base plate mounted on the frame. The base plate bears a hinge arm to which a hinge boss is articulated by a hinge pin. The base plate is fixed to the frame by a fixing screw. An eccentric is mounted in the base plate and enables the position of the hinge arm on the base plate to be adjusted.

10 Claims, 2 Drawing Sheets

HINGE FOR FURNITURE

BACKGROUND OF THE INVENTION

The invention relates to a hinge having a hinge boss which may be sent in a door and a hinge arm which may be secured to a frame of an article of furniture and is connected to the hinge boss by at least one hinge pin. The hinge arm is mounted on the frame by a base plate that is fixed on the frame by at least one fixing screw or dowel.

In modern furniture construction so-called door frames are in increasingly widespread use, such frames being the stable part which bears the hinges for a door, the actual side walls of the carcass of the item of furniture being made of weaker material. This gives the advantage that either the total costs of the item of furniture can be reduced, since the side walls may be extremely thin, or materials of higher quality which are consequently more attractive in appearance can be selected for the side walls, without the furniture being more expensive than conventionally manufactured furniture.

Such a hinge, in which the base plate embraces a frame of an item of furniture in a U-shape, is known from U.S. Pat. No. 4,604,769. U.S.Pat. No. 4,554,708 discloses a frame hinge whose base plate embraces the frame in a U-shape, having a fixed member at one side and a resilient tongue at the other side. The base plate can therefore be mounted on various frames which vary slightly in width. The clamping pressure exerted by the resilient tongue is not sufficient to hole the base plate in position on the frame. The base plate is therefore screwed onto the frame.

SUMMARY OF THE INVENTION

The object of the invention is to improve such a hinge so that precise adjustment of the door overlay with respect to the frame is easily possible.

The object according to the invention is achieved by the fact that an eccentric is mounted on the base plate, by means of which eccentric the position of the hinge arm on the base plate can be adjusted.

In an embodiment of the invention, in order to prevent the hinge arm from slipping, two edge webs of the hinge arm are disposed at right angles to the hinge pin, and each edge web is provided with at least one tooth that meshes with a ribbing on the base plate.

According to a further embodiment of the invention, a good hold of the hinge on the frame of the piece of furniture is achieved by the fact that the base plate has a fixing web which rests laterally against the frame and is provided with a hole, preferably an elongated hole, through which a fixing screw projects, and by the fact that the base plate has a bearing web which rests against the front of the frame and bears the hinge arm.

BRIEF DESCRIPTION OF THE DRAWINGS

An exemplary embodiment of the invention is described in detail below with reference to the appended drawings, wherein.

DETAILED DESCRIPTION OF THE INVENTION

Figure 1:
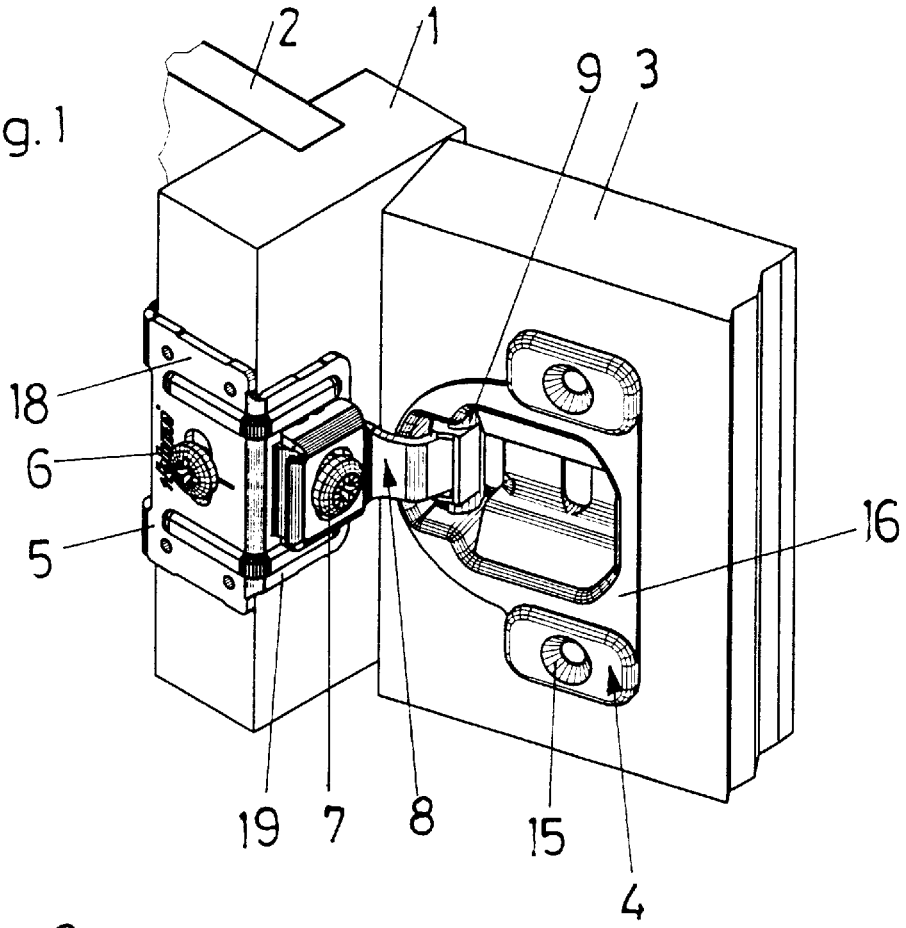
FIG. 1 is a perspective view of a hinge according to the invention in the mounted position, sections of a frame and of a door being shown.
Figure 2:
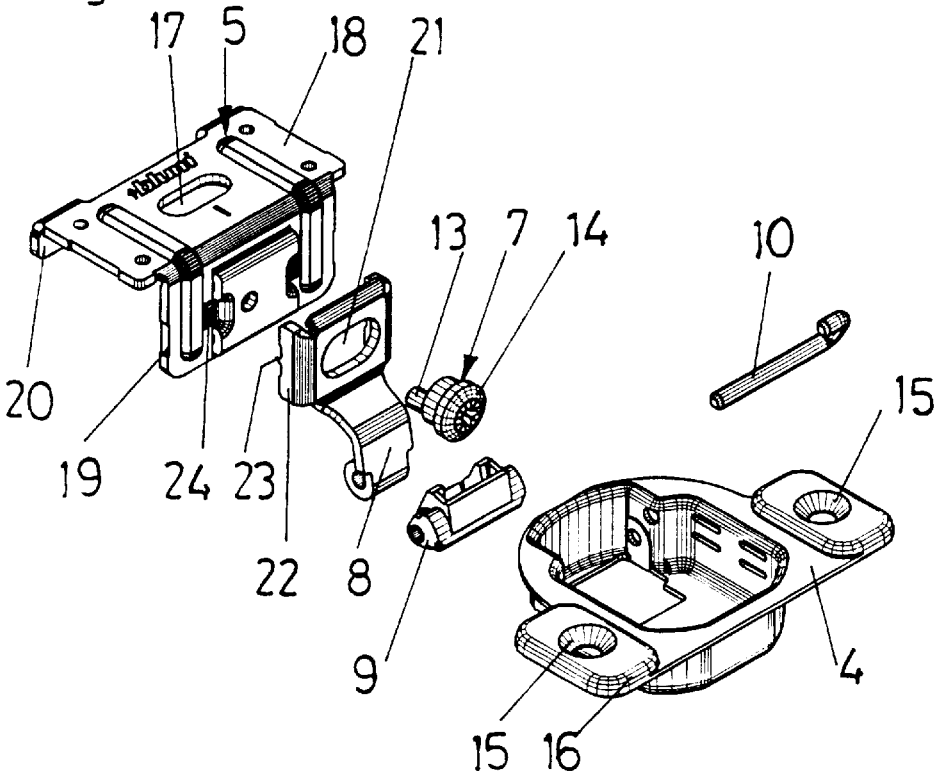
FIG. 2 is an exploded perspective view of the parts of the hinge.
Figure 3:
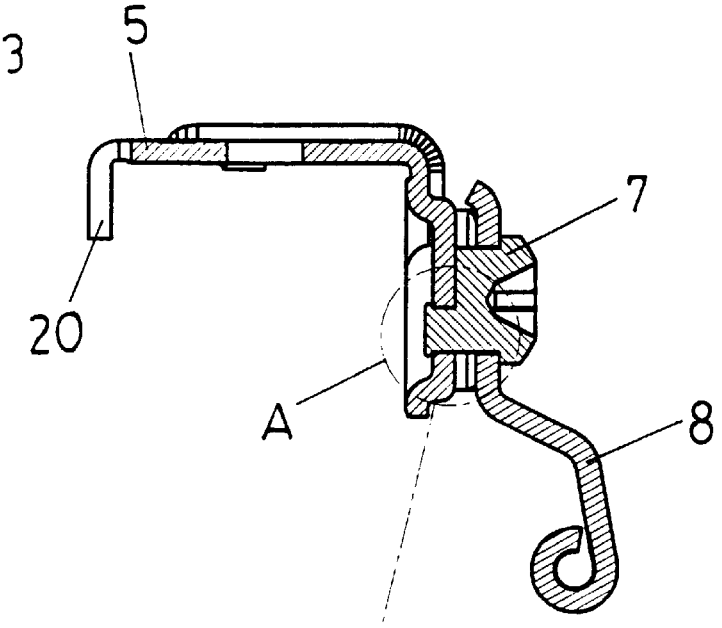
FIG. 3 is a horizontal sectional view of the hinge.
Figure 4:
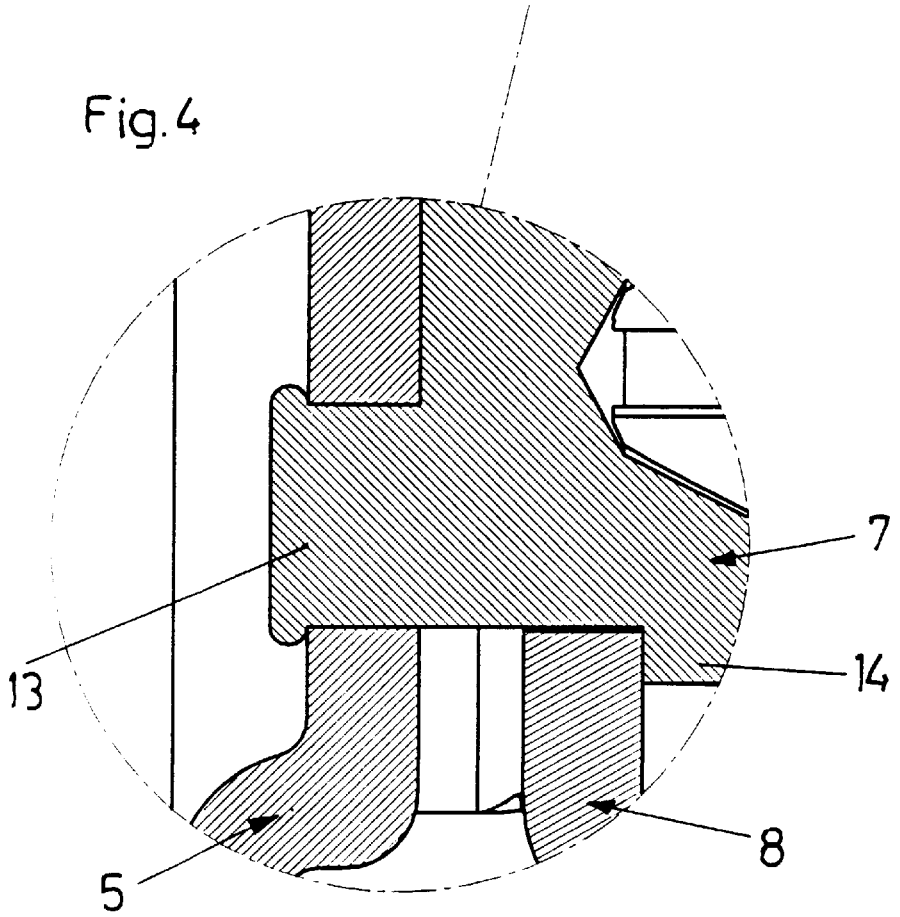
FIG. 4 is an enlarged view of detail A of FIG. 3.

In FIG. 1 a door 3 is shown in an open position. A hinge connects the door 3 to frame 1 of a piece of furniture, e.g. a cabinet. Side wall 2 of the piece of furniture is also shown in FIG. 1. The hinge includes hinge arm 8, base plate 5 and hinge boss 4, which is mounted on the door 3. The hinge boss 4 is hinged to the hinge arm 8 by a hinge pin 10. The hinge boss 4 is set into a drilled hole in the door 3 and screwed onto the door 3 by means of screws (not shown) which project through holes 15 in flanges 16 of the hinge boss. Situated at the bottom of the hinge boss 4 is a retaining part in which springs of a closing mechanism are mounted. The springs press on a cam member 9 which is mounted at the free end of the hinge arm 8. The hinge boss 4 is held in the closed position or, if the angle between the door 3 and the closing plane is very small, is pulled into the closed position by the springs.

The base plate 5 is mounted directly on the frame 1 of the piece of furniture by a screw 6 screwed into the frame 1. The screw 6 projects through an elongated hole 17 in fixing web 18 of the base plate 5. Over the length of the elongated hole 17, the position of the hinge can be adjusted heightwise on the piece of furniture. The base plate 5 has at the side facing the door 3 a bearing web 19 which in the fitted position rests against the front of the frame 1 and bears the hinge arm 8. At the rear side of the frame 1 the base plate 5 is provided with two flaps 20 which rest against the back of frame 1. Mounted in the bearing web 19 is an eccentric 7 which is riveted in the bearing web 19 by means of a peg 13. The eccentric 7 projects through an elongated hole 21 in the hinge arm 8 and has a head 14 that holds the hinge arm 8 on the base plate 5. Turning the eccentric 7 causes the hinge arm 8 to be displaced on the base plate 5 in the direction of the door overlay, i.e. in a direction parallel to the door in the closed position.

The hinge arm 8 has two edge webs 22 disposed perpendicular to the hinge pine 10. On each of which webs 22 is formed a tooth 23. Each tooth 23 is supported on and meshes with a respective ribbing 24 on the bearing web 19 of the base plate 5, so that an undesirable shift of the hinge arm 8 on the base plate is avoided.

I claim:

1. A hinge for articulating a door to a frame of an article of furniture to enable movement of the door between open and closed positions thereof with respect to the frame, said hinge comprising:

a hinge boss to be mounted on the door;

a base plate to be mounted on the frame by at least one fixing screw, said base plate having ribbings;

a hinge arm having a first end hinged to said hinge boss by at least one hinge pin and a second end having two edge webs extending transverse to said at least one hinge pin, each said edge web having extending therefrom at least one tooth; and an eccentric mounting said second end of said hinge arm on said base plate with said teeth of said edge webs meshing with respective said ribbings, said eccentric being operable to move said hinge arm with respect to said base plate in a direction transverse to said hinge pin and to be parallel to the door when in the closed position thereof.

2. A hinge as claimed in claim 1, wherein said eccentric extends through an elongated hole in said second end of said hinge arm and has a head that abuts a side of said second end of said hinge arm opposite said base plate.

3. A hinge as claimed in claim 2, wherein said hole is elongated in a direction parallel to said hinge pin.

4. A hinge as claimed in claim 1, wherein said eccentric includes a peg that is riveted to said base plate.

5. A hinge as claimed in claim 1, wherein said base plate includes a fixing web to rest laterally against the frame and having a hole through which is to extend the fixing screw.

6. A hinge as claimed in claim 5, wherein said hole is elongated.

7. A hinge as claimed in claim 5, wherein said base plate further includes a bearing web extending transverse to said fixing web and to rest against a front of the frame, said eccentric being mounted on said bearing web.

8. A hinge as claimed in claim 7, wherein said eccentric includes a peg that is fixed to said bearing web.

9. A hinge as claimed in claim 8, wherein said peg is riveted to said bearing web.

10. A hinge as claimed in claim 8, wherein said eccentric is rotatable about a center axis thereof, and said peg extends parallel to said axis and is radially offset therefrom.

* * * * *